United States Patent [19]

Gamble

[11] 4,228,347

[45] Oct. 14, 1980

[54] ELECTROMAGNETIC COUNTING MECHANISM

[75] Inventor: John G. Gamble, Simsbury, Conn.

[73] Assignee: Veeder Industries Inc., Hartford, Conn.

[21] Appl. No.: 945,422

[22] Filed: Sep. 25, 1978

[51] Int. Cl.[3] ..... G06M 1/10

[52] U.S. Cl. ..... 235/92 C

[58] Field of Search ..... 235/92 C; 335/140, 181

[56] References Cited

U.S. PATENT DOCUMENTS

| | | | |
|---|---|---|---|
| 2,798,670 | 7/1957 | Boyer | 235/92 C |
| 3,047,224 | 7/1962 | Ray et al. | 235/92 C |
| 3,551,648 | 12/1970 | Zimmerman et al. | 235/92 C |

*Primary Examiner*—Joseph M. Thesz

*Attorney, Agent, or Firm*—Prutzman, Kalb, Chilton & Alix

[57] ABSTRACT

An electromagnetic counting mechanism having a rotary counter and an electromagnetic operator with a pivotal clapper adapted to be magnetically actuated for indexing the counter. The clapper has a primary air gap and a tangential projection which cooperates with an edge of a pole of the electromagnet to provide a secondary air gap to reduce the rate of increase of magnetic force as the clapper is pivoted to its closed gap position and so that the magnetic force/clapper displacement curve has a generally flattened slope less than that of the return spring force/clapper displacement curve for stable pivotal operation of the clapper with a shaped drive pulse.

6 Claims, 5 Drawing Figures

ELECTROMAGNETIC COUNTING MECHANISM

SUMMARY OF THE INVENTION

The present invention relates generally to electromagnetic counting mechanisms of the type having a rotary counter and an electromagnetic operator with a pivotal clapper adapted to be magnetically actuated for indexing the counter.

A primary object of the present invention is to provide a new and improved electromagnetic counting mechanism of the type described which is adapted to provide extremely quiet operation.

Another object of the present invention is to provide a new and improved electromagnetic counting mechanism having operating characteristics which permit the counter to be indexed with little or no mechanical impact.

A further object of the present invention is to provide a new and improved quiet odometer of the electromagnetic type.

A further object of the present invention is to provide a new and improved electromagnetic counting mechanism adapted for low cost mass production and useful as a vehicle odometer with a long maintenance-free life.

Another object of the present invention is to provide a new and improved electromagnetic counting mechanism useful in applications having a wide applied voltage range and/or a wide temperature range.

Other objects will be in part obvious and in part pointed out more in detail hereinafter.

A better understanding of the invention will be obtained from the following detailed description and the accompanying drawings of an illustrative application of the invention.

DESCRIPTION OF THE PREFERRED EMBODIMENT

Figure 1:
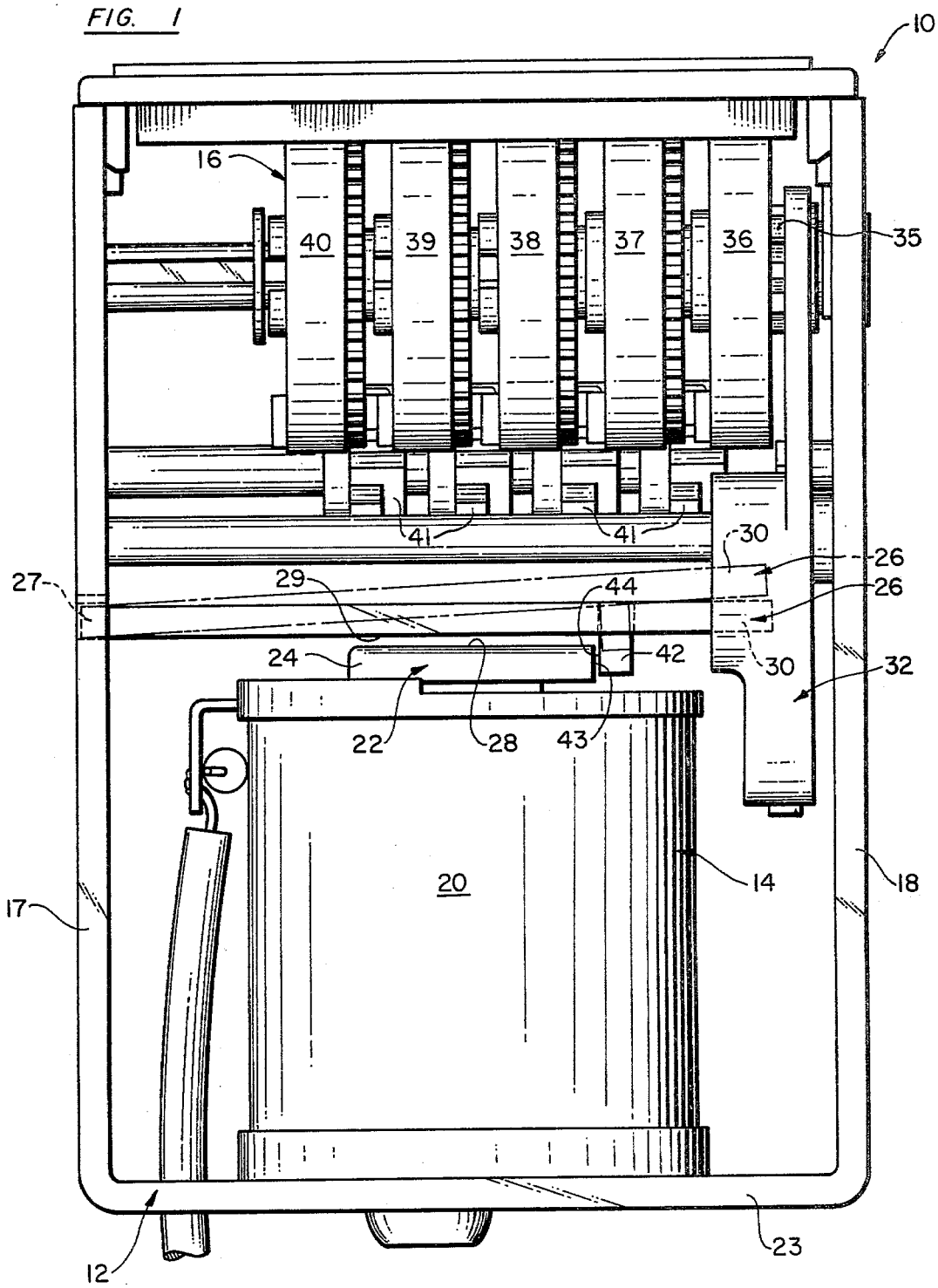
FIG. 1 is an enlarged plan view, partly broken away and partly in section, of an electromagnetic counting mechanism incorporating an embodiment of the present invention.

Referring now to the drawings in detail wherein like reference numerals indicate like parts throughout the several figures, an electromagnetic counting mechanism 10 incorporating an embodiment of the present invention is in general constructed like the electromagnetic counting mechanism shown and described in U.S. Pat. No. 3,963,903 of Dominick Pirro et al, dated June 15, 1976 and entitled "Resettable Counting Mechanism." Accordingly, except for the improvement provided by the present invention, the electromagnetic counting mechanism 10 will not be described in detail and reference should be made to U.S. Pat. No. 3,963,903 for any additional details concerning the design and operation of the counter 10.

Figure 2:
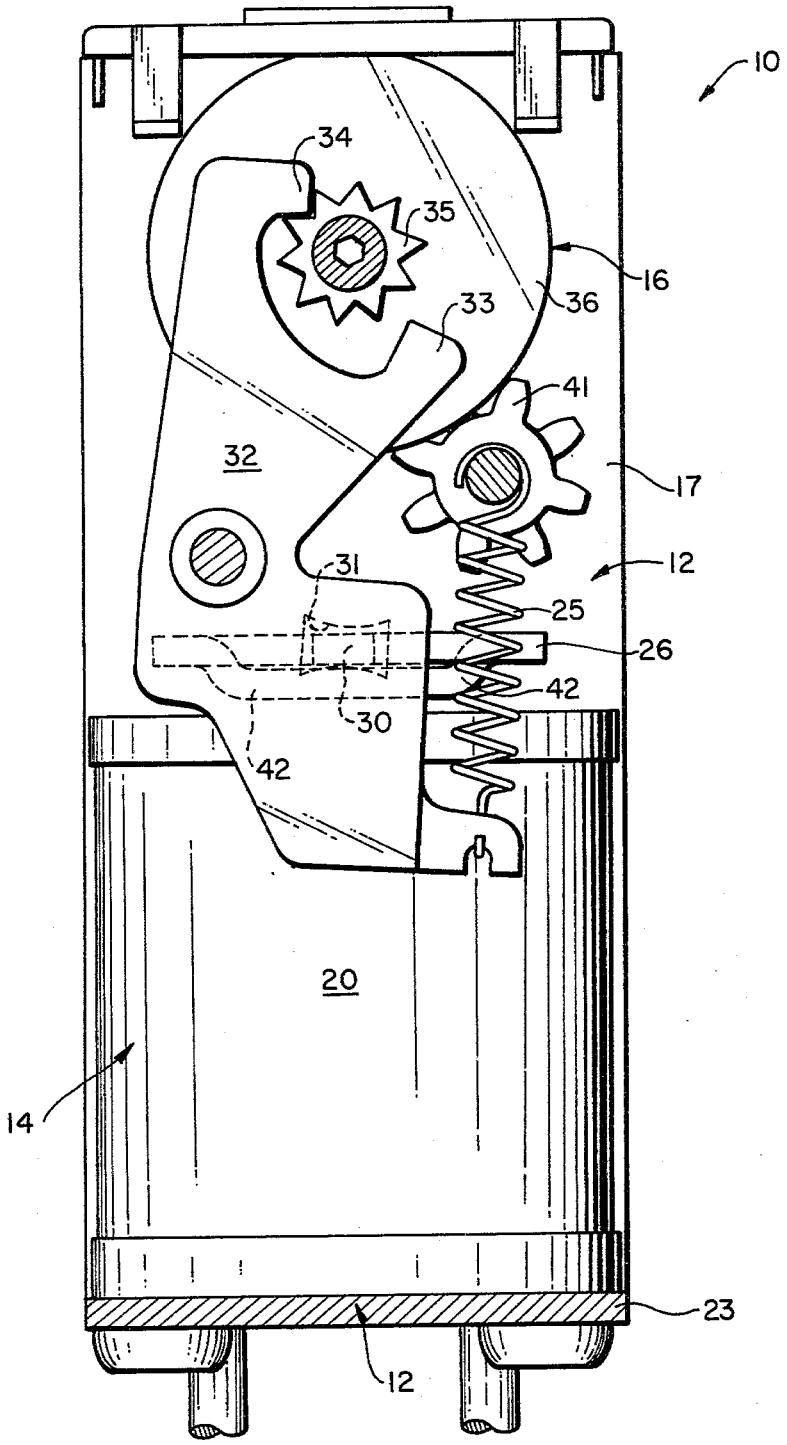
FIG. 2 is a side section view, partly broken away and partly in section, of the counting mechanism.

Briefly, however, the electromagnetic counting mechanism 10 has a generally U-shaped ferromagnetic frame 12 which forms part of an electromagnet 14. The electromagnet 14 is connected for mechanically indexing a rotary counter or indicator 16 mounted between the legs 17, 18 of the frame 12. The electromagnet 14 has an energizaton coil 20 which encircles a core 22 secured to the base 23 of the U-shaped frame 12. An inner enlarged end 24 of the core 22 provides a pole for operating a pivotal ferromagnetic armature or clapper 26. The clapper 26 has a support tang 27 received within a slot in the leg 17 of the frame 12 to support the clapper 26 for pivotal actuation by the electromagnet 14 from a withdrawn or open gap position (shown in broken lines in FIG. 1) to an extended or closed gap position (shown in FIG. 2 and in full lines in FIG. 1). The clapper 26 is mounted to provide a very low reluctance path with the leg 17 of the U-shaped frame 12 and whereby the magnetic circuit of the electromagnet 14 comprises the core 22, the base 23 and leg 17 of the frame 12 and the pivotal clapper 26. A primary pole face 28 of the electromagnet 14 is positioned in tangential alignment with an opposed generally parallel pole face 29 of the clapper 26 to provide a tangential magnetic force for actuating the clapper 26.

An outer tang 30 of the pivotal clapper 26 is received within a slot 31 of a pivotal lever or verge 32. A return tension spring 25 is connected to the verge 32 so that the verge 32 is pivoted back and forth in conjunction with pivotal operation of the clapper 26 upon energization and de-energization of the electromagnet coil 20. The verge 32 has a pair of opposed points or drive pawls 33, 34 (FIG. 2) for stepwise engagement with and advancement of a star wheel 35 connected to a lowest order number wheel 36 of the counter 16. The lowest order number wheel 36 and four remaining higher order number wheels 37–40 of the counter 16 are interconnected in a conventional manner by intermediate transfer pinions 41.

In accordance with present invention, the clapper 26 is formed, preferably during the clapper blanking step, to provide a tangentially projecting and transversely extending generally U-shaped bridge or tab 42. Also, the otherwise circular pole 24 of the electromagnet 14 is formed with a flat edge 43 which provides a secondary pole face that cooperates with an opposed radially inwardly facing secondary pole face 44 on the bridge projection 42 to form a secondary, relatively small radial air gap (e.g. of approximately 0.005 inch). With the clapper 26 in its fully withdrawn position, the opposed secondary pole faces 43, 44 on the pole 24 and clapper 26 preferably overlap slightly to ensure an incipient magnetic coupling when the electromagnet is energized. Also, the secondary radial air gap between the secondary pole faces 43, 44 remains substantially constant but may diminish slightly as the clapper 26 pivots to its minimum air gap position shown in full lines in FIG. 1. Accordingly, the secondary air gap between the secondary pole faces 43, 44 is substantially less than the primary air gap between the primary pole faces 28, 29 when the clapper 26 is fully withdrawn and such that the secondary air gap provides the principal flux path coupling at relatively low current and during incipient pivotal movement of the clapper 26 from its withdrawn position. As the clapper 26 pivots toward the primary pole face 28, a steadily increasing portion of the magnetic flux passes directly between the primary pole faces 28, 29. Also, preferably the clapper 26 is dimensioned so that it saturates below the maximum operational flux field of the electromagnet, and, as shown, the primary pole faces 28, 29 are positioned radially inwardly of the secondary pole faces 43, 44 and so that the flux coupling through the secondary air gap is increasingly shunted through the primary air gap as the clapper 26 pivots to its closed air gap position. Thus, the magnetic flux through the bridge projection 42 shifts to the preferred primary flux path between the primary pole faces 28, 29 due to the substantially greater effective area of the primary air gap, its preferred orientation relative to the secondary air gap, and the partial or complete saturation of the clapper. Also, the secondary pole faces 43, 44 are oriented to provide an air gap normal to the tangential direction of pivotal movement of the clapper and whereby a lower magnetic torque is produced. In addition, the primary air gap is made, for example, approximately 0.005 inch greater than normal to provide, for example, an open air gap of approximately 0.040 inch and a closed air gap of approximately 0.010 inch. The collective effect of the non-tangential secondary air gap with a relatively small effective area and the tangential primary air gap with a relatively large effective area flattens the general slope of the magnetic force/clapper displacement curve at each instantaneous current level.

Figure 5:
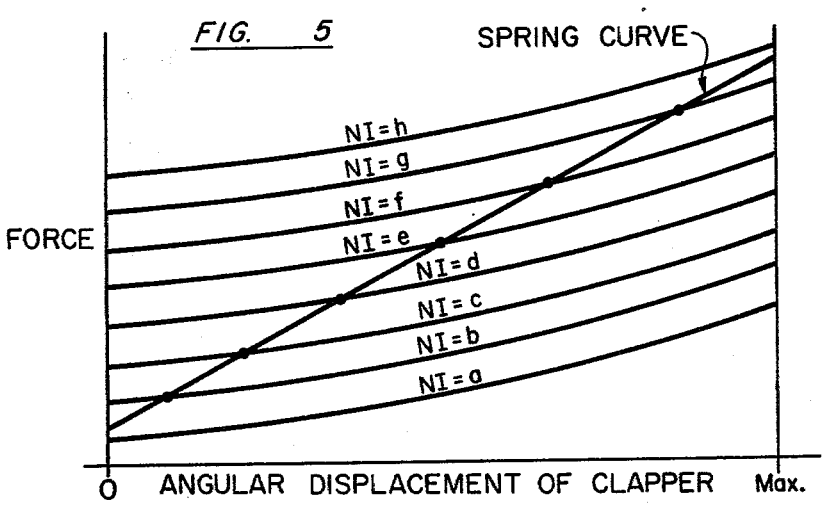
FIG. 5 is a graph illustrating the operating characteristics of the counting mechanism.

Referring to FIG. 5, exemplary magnetic force/clapper displacement curves at different instantaneous current (i.e. ampere-turn or NI) levels are shown being relatively shallow and relatively linear (in relationship to those of conventional electromagnetic counting mechanisms). The provision of such a flattened magnetic force/displacement characteristic is employed in combination with a return tension spring 25 having, for example, a normal pre-load but otherwise having a somewhat different and steeper spring force/displacement curve (e.g. with a slope or spring rate twice that of a conventional spring) and which is steeper than the general slope of the magnetic force/displacement curves. An exemplary spring force/displacement curve is also shown in the graph of FIG. 5 to illustrate that relationship.

Such an arrangement wherein the spring force increases at a rate greater than the magnetic force (i.e. at each instantaneous current level) permits fully controlled and stable pivotal operation of the clapper between its fully withdrawn or open gap position and its fully extended or closed gap position. Accordingly, by controlling the current/time profile of the electromagnet, the pivotal movement of the clapper can be controlled to reduce or completely eliminate the usual mechanical impact by the points 33, 34 of the pivotal verge 32 with the counter star wheel 35 (or reduce or eliminate any mechanical impact with other mechanical stops, not shown, that may be provided).

Figure 3:
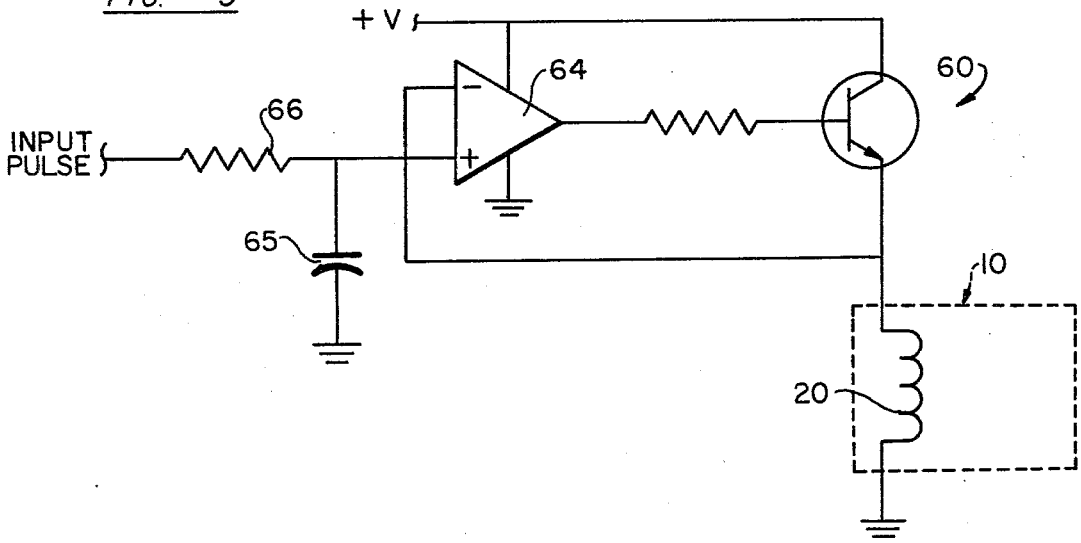
FIG. 3 is a schematic, partly broken away, showing an exemplary drive pulse shaping circuit useful with the counting mechanism.
Figure 4:
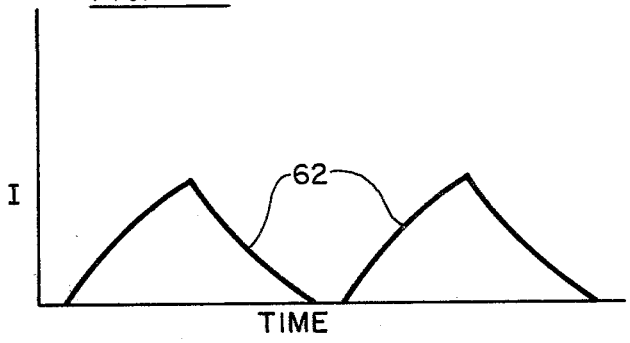
FIG. 4 is a graph showing exemplary counter drive pulses formed by the pulse shaping circuit.

An exemplary drive circuit 60 and exemplary shaped electrical drive pulses 62 provided by the circuit 60 for operating the electromagnet are shown in FIGS. 3 and 4 respectively. The electrical drive pulses 62 are shown having a generally pyramid shape with increasing and decreasing current ramps (e.g. having 0.5 and 0.6 second intervals respectively) to relatively gradually attract and gradually release the clapper and whereby the instantaneous clapper position is a function of the instantaneous current. Of course, the actual desired rate of change of the current depends upon the application and dynamic characteristics of each particular configuration. In addition, the maximum current level can be readily made sufficient to ensure complete and reliable counter actuation without additional mechanical impact.

The exemplary drive circuit 60 shown in FIG. 3, in a known manner, employs a voltage feedback loop to an error amplifier 64 to control the rate of change of coil applied voltage (and therefore the rate of change of coil current) in accordance with the rate of change of the voltage at the junction of a storage capacitor 65 and an input resistor 66.

Thus, it can be seen that the electromagnetic counting mechanism of the present invention is designed for stable clapper operation and whereby the clapper can be actuated without mechanical impact and yet at the desired counting rate to provide an extremely quiet counter for example, for vehicle odometer applications and the like where quiet operation is increasingly valued. Also, non-impact or low impact mechanical operation of the counter can be employed to ensure both a long maintenance-free life and counting reliability.

As will be apparent to persons skilled in the art, various modifications, adaptations and variations of the foregoing specific disclosure can be made without departing from the teachings of the present invention.

I claim:

1. In an electromagnetic counting device having a rotary counter and an electromagnetic operator adapted for indexing the counter comprising an electromagnet with a ferromagnetic core having a primary pole face, a ferromagnetic clapper pivotally mounted in operative magnetic association with the core having a primary face portion in direct tangential alignment with said primary pole face to be directly magnetically attracted thereby when the electromagnet is energized and adapted to be magnetically pivotally actuated in one pivotal direction from a withdrawn position to an extended position by energization of the electromagnet, spring means biasing the clapper in the opposite pivotal direction to its withdrawn pivotal position with an angular bias which increases with the pivotal displacement of the clapper therefrom and indexing means operable by the clapper for indexing the counter in stepwise fashion upon pivotal movement of the clapper, the improvement wherein the electromagnet core comprises a secondary generally tangentially extending pole face having an area substantially less than the area of the primary pole face and wherein the clapper comprises a secondary generally tangentially extending face portion adjacent to but out of alignment with said primary pole face and spaced from said secondary pole face at a generally constant air gap therewith, but in increasingly overlapping relationship therewith, as the clapper is electromagnetically pivoted from its withdrawn to it extended position so that the electromagnet is operable to produce a magnetic force which increases with pivotal displacement of the clapper from its withdrawn position at a general rate less than the general rate of increase of the spring bias in the opposite direction and whereby the clapper is adapted to be pivotally actuated in accordance with the instantaneous current of the electromagnet.

2. An electromagnetic counting device according to claim 1 wherein said primary face portion of the clapper and said primary pole face are generally flat and parallel and extend generally radially and wherein said secondary face portion of the clapper is generally normal to the plane of said generally flat primary face portion.

3. An electromagnetic counting device according to claim 1 or 2 wherein the pivotal clapper is mounted with its pivot axis adjacent to the electromagnet core to provide a low reluctance path therebetween and wherein said secondary face portion of the clapper is radially outwardly of said primary face portion so that the magnetic field between the secondary face portion and secondary pole face is at least partially shunted via the primary face portion and primary pole face as the clapper is magnetically pivoted to its extended position.

4. An electromagnetic counting device according to claim 1 or 2 wherein the clapper has a tangentially extending portion with said secondary generally tangentially extending face portion and wherein the electromagnet core has a single pole with contiguous generally mutually perpendicular faces providing said primary and secondary pole faces respectively.

5. In an electromagnetic counting device having a rotary counter and an electromagnetic operator for indexing the counter comprising an electromagnet with a ferromagnetic core, a ferromagnetic clapper pivotally mounted in direct tangential alignment with said core to be directly magnetically attracted thereby when the electromagnet is energized and adapted to be magnetically pivotally actuated in one pivotal direction from a withdrawn pivotal position thereof by energization of the electromagnet, spring means biasing the clapper in the opposite pivotal direction to its withdrawn pivotal position with an angular bias which increases with the pivotal displacement of the clapper therefrom, and indexing means operable by the clapper for indexing the counter in stepwise fashion upon pivotal movement of the clapper, the improvement wherein the electromagnet core and clapper have cooperating first and second primary pole means respectively and cooperating first and second secondary pole means respectively, the primary pole means and the secondary pole means each having continually decreasing magnetic reluctance therebetween as the clapper pivots in said one pivotal direction from its withdrawn position, said primary and secondary pole means of the core and clapper being operable to produce upon energization of the electromagnet, an angular magnetic force on the clapper in said one direction which increases with pivotal displacement of the clapper from its withdrawn position at a general rate less than the general rate of increase of the spring force in the opposite direction and whereby the clapper is adapted to be pivoted in accordance with the instantaneous current of the electromagnet.

6. An electromagnetic counting device according to claim 5 wherein said cooperating primary and secondary pole means of the electromagnet core and clapper form a secondary air gap which remains relatively constant and a primary air gap which decreases with pivotal displacement of the clapper in said one direction from its withdrawn position.

* * * * *